US005544909A

United States Patent [19]

Laughlin et al.

[11] Patent Number: 5,544,909

[45] Date of Patent: Aug. 13, 1996

[54] STEP-IN BOOT BINDING

[75] Inventors: James Laughlin, Burlington; David J. Dodge, Shelburne, both of Vt.

[73] Assignee: The Burton Corporation, Burlington, Vt.

[21] Appl. No.: 188,970

[22] Filed: Jan. 28, 1994

Related U.S. Application Data

[63] Continuation-in-part of Ser. No. 187,653, Jan. 27, 1994, abandoned.

[51] Int. Cl.[6] ..... A63C 9/18

[52] U.S. Cl. ..... 280/617; 280/631; 280/14.2

[58] Field of Search ..... 280/613, 617, 280/627, 631, 14.2

[56] References Cited

U.S. PATENT DOCUMENTS

| | | | |
|---|---|---|---|
| 3,779,570 | 12/1973 | Betschart, Jr. | 280/613 |
| 3,860,253 | 1/1975 | Schweizer . | |
| 3,945,658 | 3/1976 | Frechin . | |
| 4,863,186 | 9/1989 | Rullier et al. . | |
| 5,044,654 | 9/1991 | Meyer . | |

FOREIGN PATENT DOCUMENTS

| | | | |
|---|---|---|---|
| 0351298 | 1/1990 | European Pat. Off. | 280/14.2 |
| 2344305 | 10/1977 | France | 280/613 |
| 2329881 | 3/1974 | Germany . | |
| 2357284 | 5/1975 | Germany . | |
| 4106401A1 | 9/1992 | Germany . | |
| 4218428 | 12/1993 | Germany | 280/617 |

*Primary Examiner*—Brian L. Johnson
*Attorney, Agent, or Firm*—Wolfe, Greenfield & Sacks, P.C.

[57] ABSTRACT

A base includes a first bail that is pivotally connected to the base. A second bail is pivotally connected to the base. An operating arm is connected to the second bail and pivotally connected to the base. A trigger mechanism is connected to the second bail to move the second bail from a first unlocked position to a second locked position. The operating arm is pivoted in a first direction to cause the second bail to move from the second locked position to the first unlocked position.

17 Claims, 6 Drawing Sheets

STEP-IN BOOT BINDING

RELATED APPLICATION

This application is a continuation-in-part of application Ser. No. 08/187,653, filed on Jan. 27, 1994, entitled "Step-In Boot Binding", now abandoned.

FIELD OF THE INVENTION

The present invention relates generally to a boot binding. More specifically, the present invention relates to a snowboard boot binding which includes a trigger mechanism to which causes the binding to be locked to the boot through the simple action of stepping into the binding.

BACKGROUND OF THE INVENTION

A recently popular sport, snowboarding presents operating conditions and physical demands on boot bindings that, in many respects, are similar to other skiing-type sports. In snowboarding, the operator stands with both feet on the snowboard, somewhat similar to a Slalom-type water ski. Given the sophisticated structure of presently manufactured boots for snowboarding and the operating conditions the boots are subjected to, a reliable and tight connection between the boot and the snowboard is required. To accomplish this often requires a complex binding mechanism and considerable strength on the part of the user to unlock and lock the binding properly.

Many of the foregoing problems have been resolved with the provision of a step-in boot binding. A step-in boot binding provides a large mechanical advantage to a user and permits the binding to be moved to a locked position by simply "stepping into the boot binding". An example of this prior art type of step-in binding is disclosed in German reference DE 41 06 401.

Notwithstanding, the foregoing step-in boot binding arrangement, there are still major problems involved. The boot binding is typically maintained in a locked position by the triggering mechanism. In the German '401 reference, a spring 59 is used to bias part 57 into locking engagement with a locking catch 55 on the step-in element 5. If the triggering mechanism were to fail, the binding would no longer be positively retained in the locked position.

It is, therefore, an object of the present invention to provide a step-in boot binding that permits the use of the mechanical advantage of stepping in and locking the boot binding while simultaneously preventing an unintended unlocking of the boot binding, should the trigger mechanism fail in any respect.

It is an object of the present invention to provide a step-in boot binding that requires less parts, and thus, is smaller and easier to manufacture. It is still a further object of the present invention that the step-in boot binding arrangement be simple and cost effective to manufacture, yet reliable and efficient in use.

In accordance with a preferred embodiment demonstrating objects, features and advantages of the invention, a step-in boot binding system includes a base, first and second bails pivotally connected at opposite ends of the base, and an operating arm connected to the second bail and pivotally connected to the base, and a trigger mechanism connected to the second bail to move the second bail from an unlocked position to a boot-locking position. The operating arm is pivoted in a first direction to cause the second bail to move from the boot-locking position to the unlocked position.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
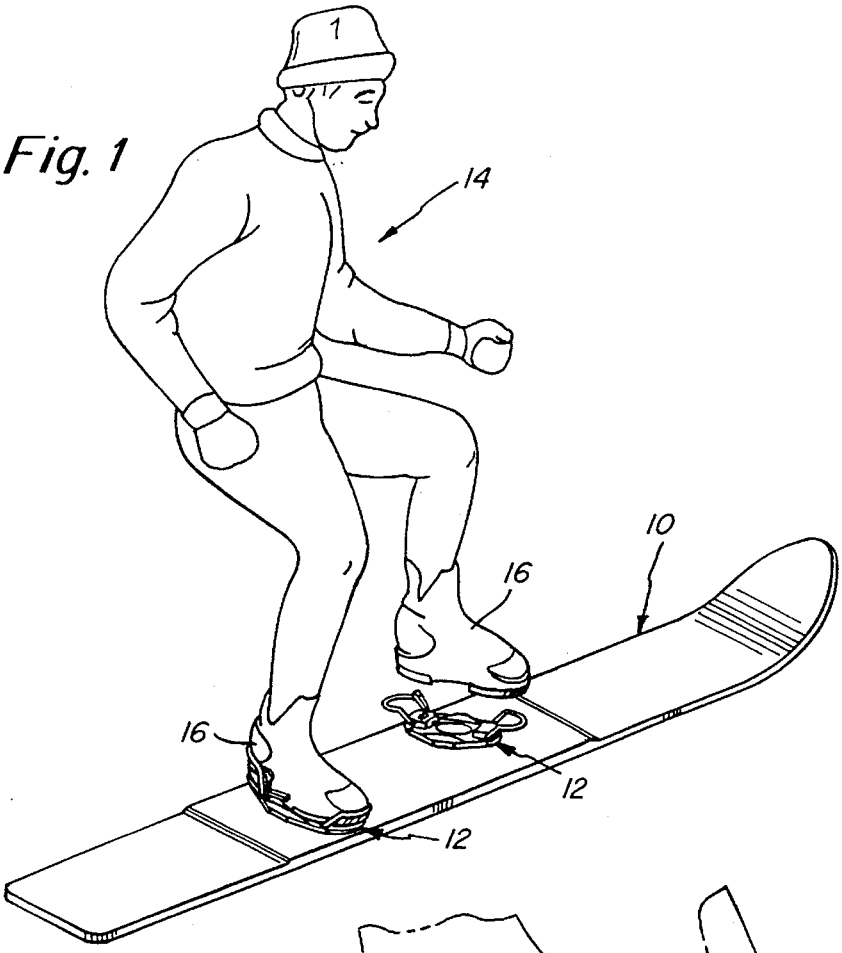
FIG. 1 is a perspective view of a rider on a snow board having a step-in boot binding according to the present invention.

Referring to FIG. 1, there is illustrated a: snowboard 10 of conventional construction and a step-in binding 12, according to the present invention, with a rider 14 having his/her boots engaged in the binding, whereby the rider 14 is supported on the board 10.

Referring now to FIGS. 2–6, the step-in boot binding arrangement includes a base 18 that is comprised of a central plate member 20 that is fixedly mounted on the snowboard and a pair of housing members 22,24 that are fixedly mounted on the plate. A first or front bail member 26 is pivotally connected to the first housing member 22; it being understood that relative orientation adjectives such as "front", "rear", "below", "above", etc. are utilized herein to simplify the present description and are not intended to limit the orientation of the boot binding assembly when mounted for use. The second or rear attachment bail 28 is pivotally connected to the second housing member 24. The first and second bails are simply pivoting wire frames, but the second or rear bail 28 is retained by a triggered locking mechanism to be described later.

In the illustrated embodiment, each of the first and second housing members 22,24 are fixedly mounted on the plate 20 by a pair of screws 30. Each of the first and second housing members 22,24 have four counter sink through bores 32 to receive the pair of screws 30. In addition, the plate member 20 includes a plurality of threaded bores 34. In this manner, the first and second housing members 22,24 can be adjustably mounted on the plate 20 to accommodate practically any size boot 16. Depending upon the orientation of the housing member with respect to the plate 20, either the inner pair or outer pair of threaded bores are used in the illustrated embodiment. It is also possible to space the screws so that one inner and one outer bore would be used, in which case, a slight lateral adjustment of the mounting position becomes possible.

A triggering mechanism 36 which includes a shaft 38 that is rotatably supported in the second housing member 24 in a plane below a boot supporting surface 40. The triggering mechanism provides for the shaft 38 to be positioned to a first (clockwise) stable position and to be triggered to move to a second (counterclockwise) stable position. The axis of the shaft 38 is substantially lateral to the length of the boot 16. An eccentric link 42 is fixedly mounted on each axial end of the shaft 38 and will rotate with it. At its ends, the second bail 28 is rotatably connected to the eccentric links 42. At least one of the eccentric links 42 includes an operating arm 44 which is fixedly connected thereto.

Figure 2:
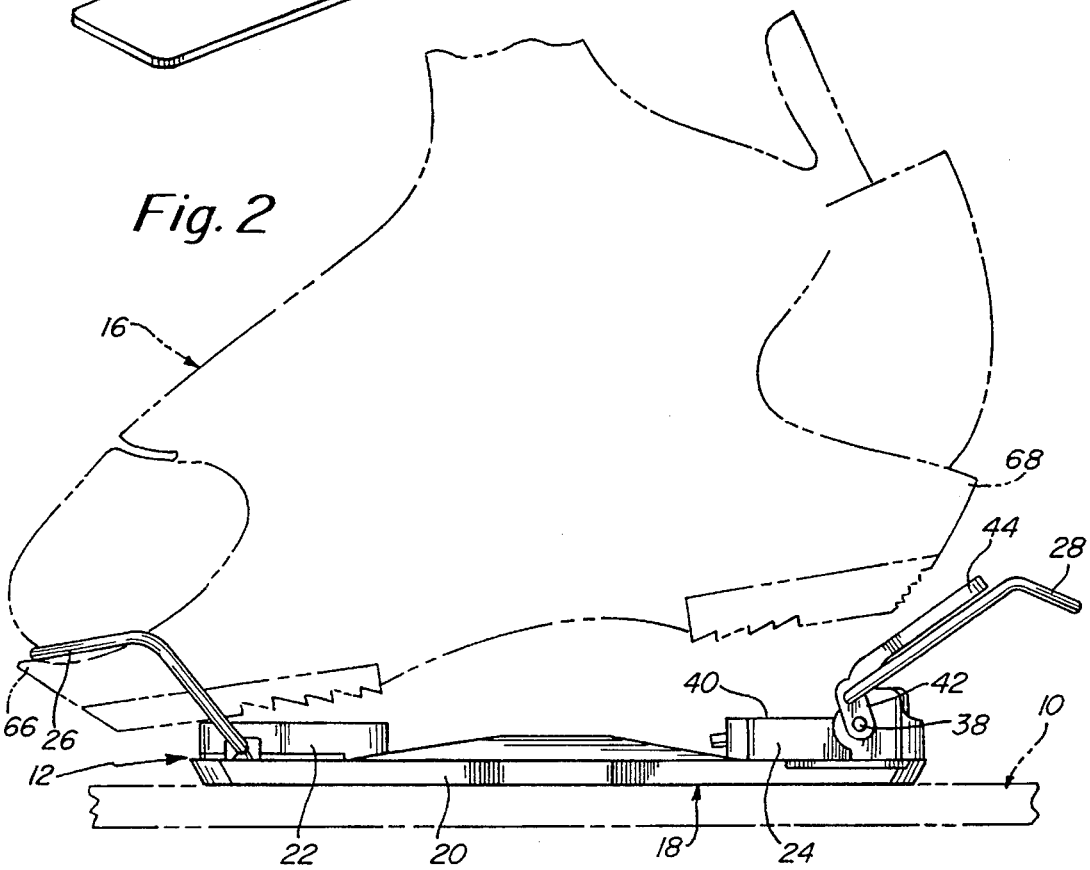
FIG. 2 is a side view of a step-in boot binding arrangement according to the present invention.
Figure 3:
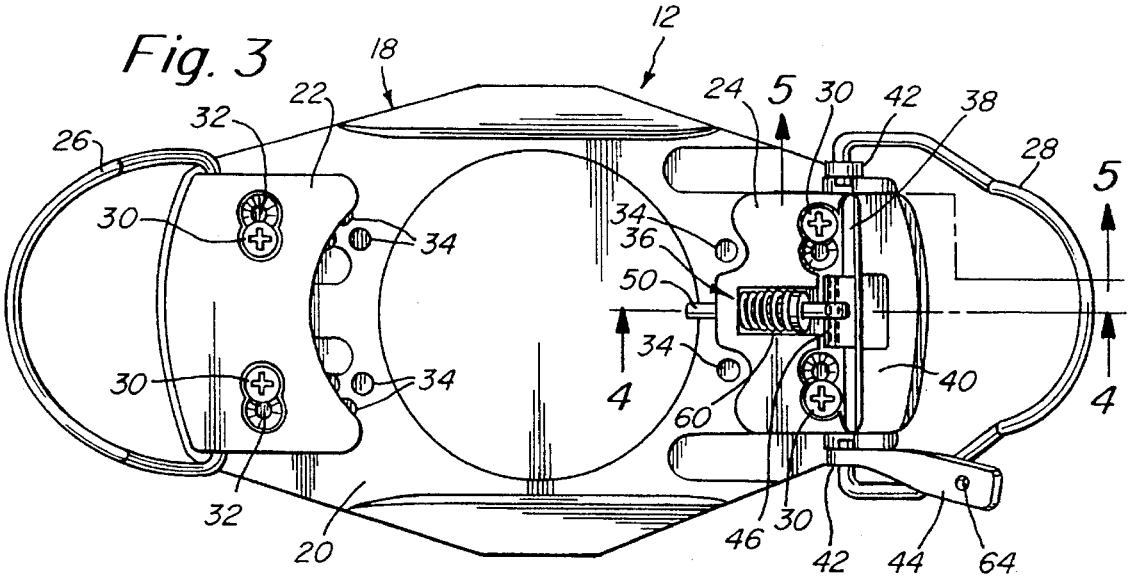
FIG. 3 is a top view of a step-in boot binding arrangement according to the present invention.

Before the boot 16 can be secured into the binding, the rear bail must first be brought to its opened position (FIG. 2). This is achieved by rotating the eccentric links 42 clockwise by means of the operating arm 44. Thereafter, the toe of the boot is placed on the front of the binding and the front bail is placed into position on the toe of the boot (see FIG. 2). Next the wearer places a rear bail 28 against the heel of the boot and steps down upon the boot supporting surface 40. This activates an internal trigger mechanism (discussed below), which causes counterclockwise rotation of the eccentric links 42 to the position shown in FIG. 7. This causes the rear bail 28 to be locked against the rear ledge 68 of the boot. With the boot so secured, it may only be removed by lifting the operating arm 44.

Trigger mechanism 36 includes a cam 46 mounted at substantially the center of the shaft 38 and immediately below boot supporting surface 40. The cam 46 protrudes above the boot supporting surface 40 when the eccentrics 42 are positioned so that the axis 48 of the bails 28 is above the axis of shaft 38 (See FIG. 4). In this position, the binding is in the unlocked or open position.

A first axial end 52 of plunger 50 is pivotally mounted to the cam 46 about an axis 62 that is parallel to and spaced between the axis of the shaft 38 and the first bail 26. The other axial end 54 of the plunger 50 is slidingly received in a bore 56 of the second housing member 24. As illustrated, the bore 56 is disposed below the axis of the shaft 38. The plunger 50 includes a flange 58 disposed between the first axial end 52 and the bore 56. A coil spring 60 is disposed about plunger 50 between flange 58 and an internal wall surface of the second housing member 24 that surrounds bore 56. Spring 60 biases the plunger 50 toward the shaft 38.

From the preceding description it will be appreciated that the trigger mechanism 36 achieves two stable positions by virtue of the action of spring 60. In the first (clockwise) stable position of shaft 38, the force of spring 60 tends to rotate cam 46 clockwise in FIG. 4. However, as seen FIG. 4, the end 29 of bail 28 projecting through eccentric 42 bears upon the housing 24 at stop 25 and prevents further rotation of the cam. When cam 46 is forced downwardly by the heel of the boot, spring 60 will cause counterclockwise rotation of the cam as soon as the axis of rotation of plunger 50 is below shaft 38. Counterclockwise rotation of shaft 38 continues until the end 29 of bail 28 engages stop 27 of housing 24 (See FIG. 5). The shaft, the eccentric links 42 and the bail 28 are then in their second stable position.

Figure 4:
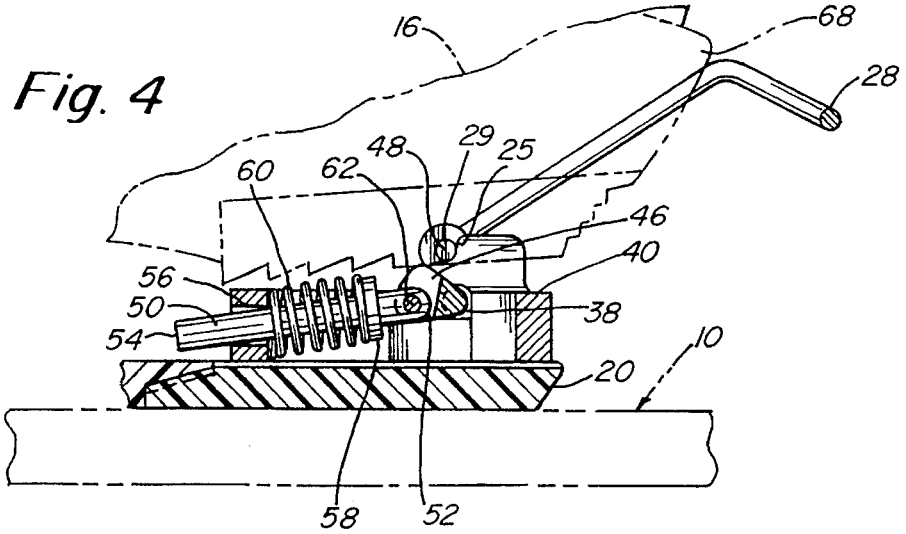
FIG. 4 is a sectional view taken along lines 4—4 of FIG. 3 and looking in the direction of the arrows.
Figure 5:
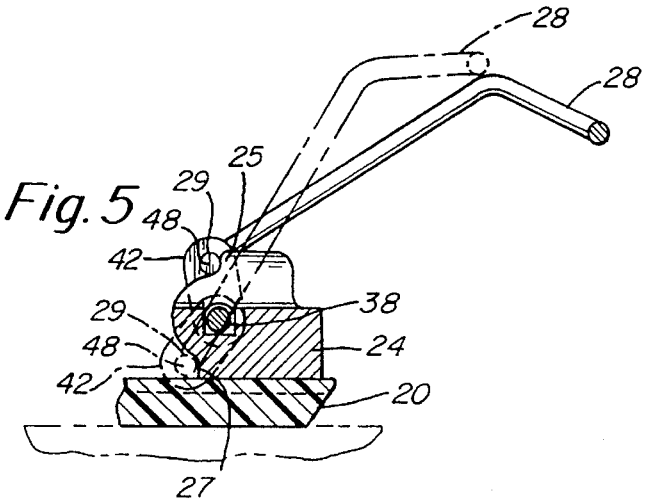
FIG. 5 is a sectional view taken along lines 5—5 of FIG. 3 and looking in the direction of the arrows.

The operation of the step-in boot binding will be described below with reference to FIGS. 2–7. The second or rear bail 28 must first be moved to the first stable, unlocked position, as illustrated in FIG. 2. To accomplish this, the user may simply pull up on the operating arm 44 to rotate cam 46 clockwise, and the bail is brought to its first position, under action of spring 60. To facilitate the lifting of the operating arm 44, a strap (not shown) may be tied to the bore 64 in the operating arm (See FIG. 3). In this first stable, unlocked position, a portion of the cam 46 protrudes above the boot supporting surface 40, as illustrated in FIG. 4.

The user then steps into the binding by inserting the forward ledge 66 of the boot 16 under the forward or first bail 26 (See FIG. 2). The user then rotates the rear bail into contact with the rear surface of the boot 16. The user will then continue to step down on the heel supporting surface 40. The weight of the heel of the user placed against the cam 46 causes the cam and the shaft 38 to rotate in a counterclockwise direction, as viewed in FIGS. 4–6, against the spring loading of the plunger 50. When the cam 46 reaches a position in which the axis of rotation of the plunger 50 is below the axis of rotation of the shaft 38, the spring loading on the plunger will cause the cam and shaft to quickly rotate further downward, in a counterclockwise direction, so that the axis of rotation of the rear bail 28 is drawn forward and downwardly into the second stable locked position, as illustrated in FIGS. 6 and 7.

Figure 6:
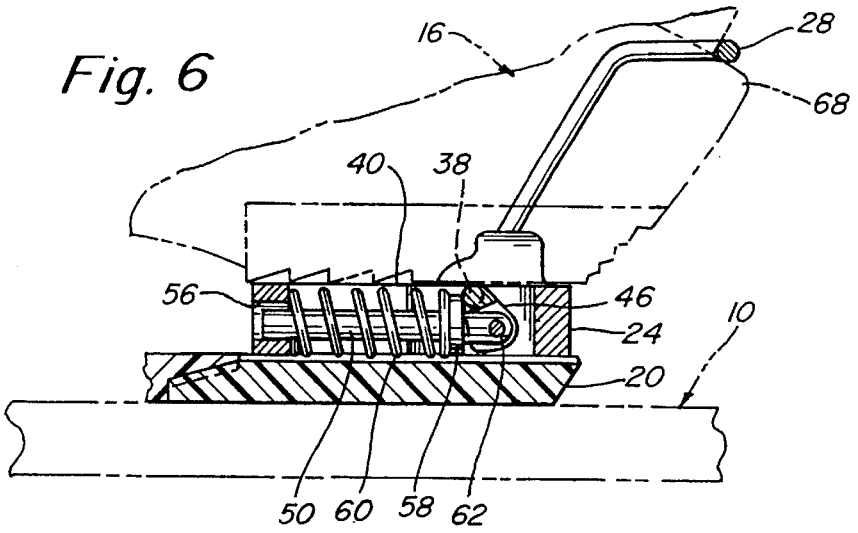
FIG. 6 is a sectional view of the cam being shown in the locked position.

In this locked position, as shown in FIG. 6, the rear bail 28 is locked against a rear boot ledge 68. Furthermore, the axis of rotation 48 of the rear bail 28 is now aligned with the axis of rotation of the shaft 38 along the direction of the rear bail 28, so that no amount of upward pressure on the heel of the boot can produce a rotation of the shaft. The boot is therefore securely retained in a locked position, even if the spring 60 of the plunger 50 were to break. The boot can now only be released by means of the operating arm 44. In this second stable, locked position, the second bail 28 is locked in position above the rear ledge 68 of boot 16 (See FIGS. 6 and 7).

Figure 7:
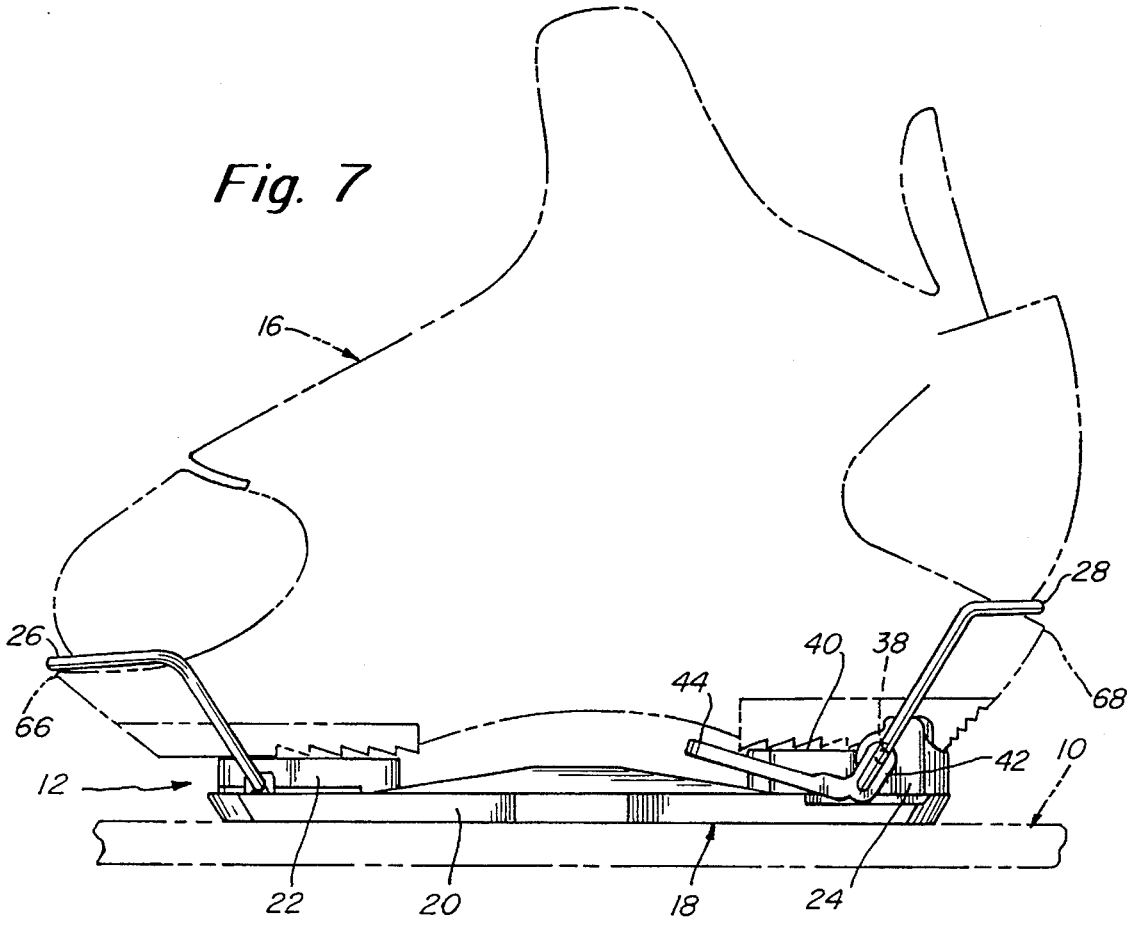
FIG. 7 is a side view of the step-in boot binding being shown in the locked position.
Figure 8:
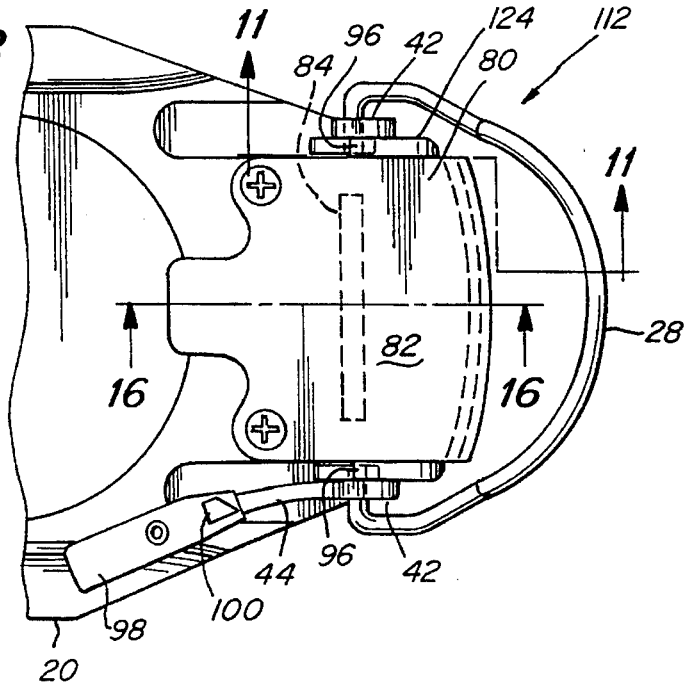
FIG. 8 is a plan view of a rear portion of an alternative embodiment of the binding.

To unlock the boot, the pivoting lever arm 44 must be rotated in a clockwise direction, as viewed in FIG. 7, to cause the second bail 28 to move from the second locked position to the first unlocked position. As the connecting cam 46 is first lifted, the force of the spring 60 must be overcome until the cam reaches a position in which the axis of rotation of the plunger 50 is above the axis of rotation of the shaft 38. Then, the spring loading of the plungers 50 will cause the cam 46 and shaft 38 to rotate further so that the axis of the rotation of the rear bail is drawn upward and into the first stable unlocked position. The user is now free to step out of the boot binding.

The step in boot binding of the present invention can include several additional safety features to improve the use of the step in boot binding. These alternate embodiments are shown in FIGS. 8–18.

Figure 14:
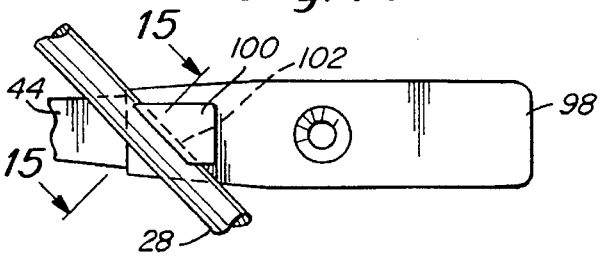
FIG. 14 is a fragmentary elevation taken essentially along line 14—14 of FIG. 13.
Figure 15:
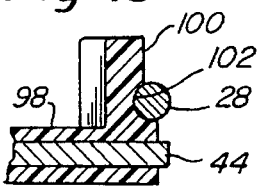
FIG. 15 is a fragmentary sectional vie w taken essentially along line 15—15 of FIG. 14.
Figure 16:
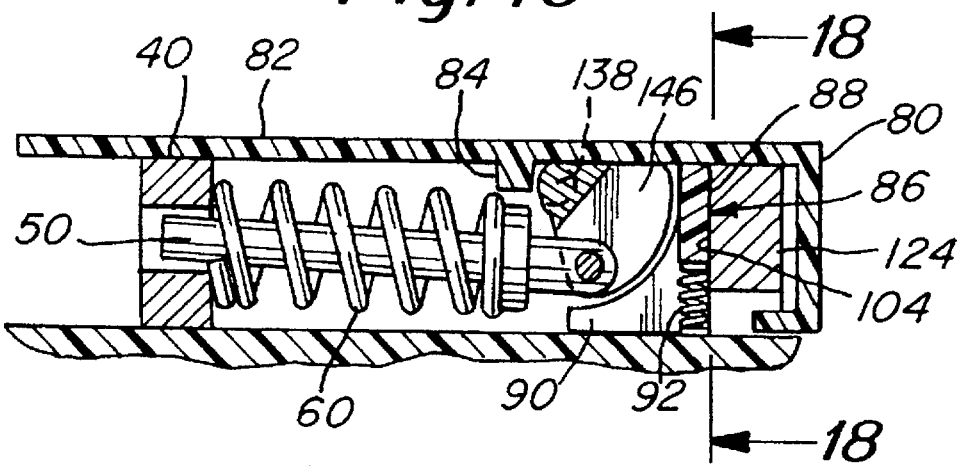
FIG. 16 is a sectional view taken along line 16—16 of FIG. 8, showing the cam in the locked position.
Figure 17:
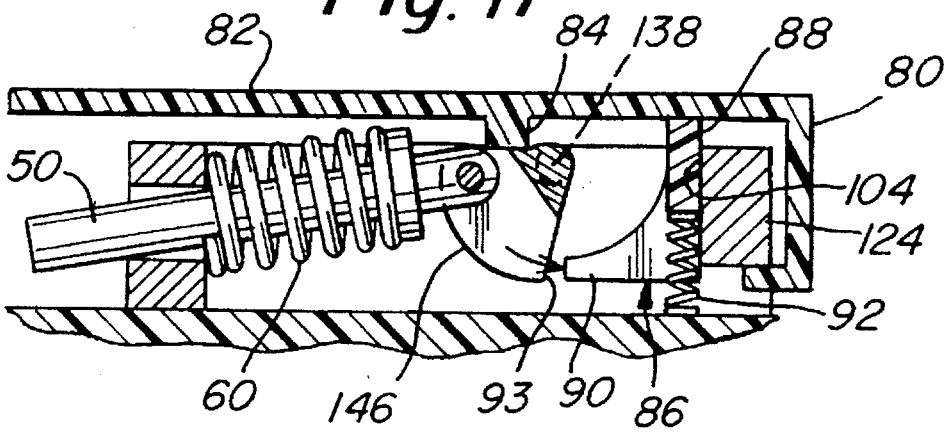
FIG. 17 is similar to FIG. 16, however, showing the cam in the open position.
Figure 18:
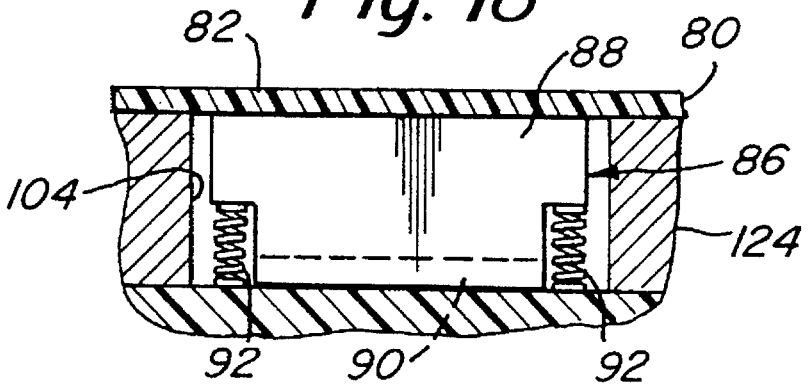
FIG. 18 is a fragmentary section showing the cam lock mechanism taken along line 18—18 of FIG. 16.

Referring now to FIGS. 8–18, there is shown a portion of an alternate embodiment 112 of the step-in binding, in which a cover plate 80 is coupled to housing member 124 in such a manner that a plate surface 82 of cover plate 80 is disposed above the boot supporting surface 40 (See FIGS. 16 and 17). The cover plate has a downwardly depending rib-like projection 84 which is positioned to engage the protruding portion of the cam 146 when the cam is in the opened position and the user steps on the cover plate.

The use of the cover plate 80 ensures that when the user steps down on the heel supporting surface 40, the weight of the heel of the user will be placed against the cam 146 via the cover plate 80 and its downwardly depending projection 84, to cause the cam and the shaft 38 to rotate in a counterclockwise direction.

A cam interlock 86 is disposed between cam 146 and housing member 124. Cam interlock 86 is substantially L-shaped and includes an upwardly extending projection 88, disposed in a slot 104 of housing 124, and a laterally extending projection 90. Cam interlock 86 is mounted for vertical sliding movement and is spring biased by spring 92 to a first, uppermost position (FIG. 17). When the cam interlock 86 is disposed in this first position, it prevents cam 146 from pivoting counterclockwise from its first stable, opened position to the second stable, locked position. As illustrated in FIG. 17, cam 146 pivots about axis 162 until a surface 93 of cam 146 engages projection 90 of cam lock 86, preventing further counterclockwise rotation. Thus, the inadvertent closing of the step in boot binding can be prevented.

To close the step-in binding on the boot, the user must first step down on the cover plate 80 which causes the cam interlock 86 to move downwardly to a second position, as illustrated in FIG. 16. The user will then continue to step down on the cover plate 80, which causes the surface 92 of the cam 146 to clear the projection 90 of the cam interlock and permits the cam 146 and shaft 138 to quickly rotate further downward in a counterclockwise direction, into the locked position illustrated in FIG. 16.

Referring now to FIGS. 11–15, another feature of the alternate embodiment of the present invention is illustrated. The ends 129 of the bail 28 have cams 94 rigidly fixed thereto. Cams 94 prevent the bail 28 from being removed from the assembly. In addition, the rear housing member 124 includes a forwardly extending projection 96 above stop 125. In use, bail 28 must be moved to the first stable, unlocked position prior to placing a boot within the binding. To accomplish this, the user simply pulls up on the operating arm 44 to rotate cam 146 clockwise and the bail 28 is brought to its first position under the action of spring 60.

Figure 9:
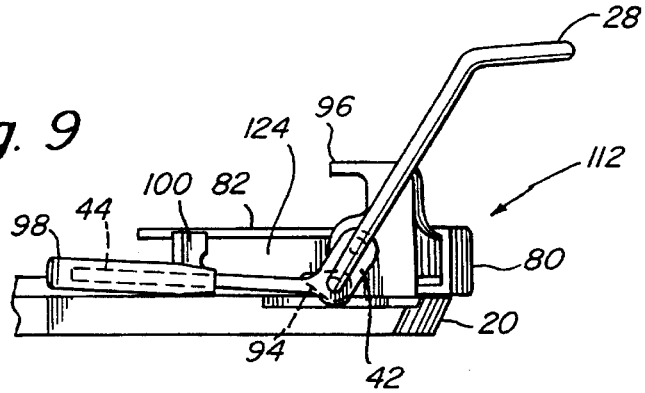
FIG. 9 is a fragmentary side elevation of the binding of FIG. 8, showing the bail in the locked position.
Figure 10:
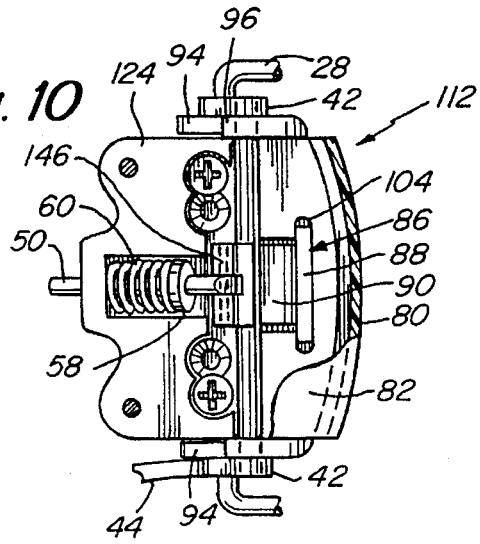
FIG. 10 is a plan view of a heel plate shown in FIG. 8, with the plate cover broken away.
Figure 11:
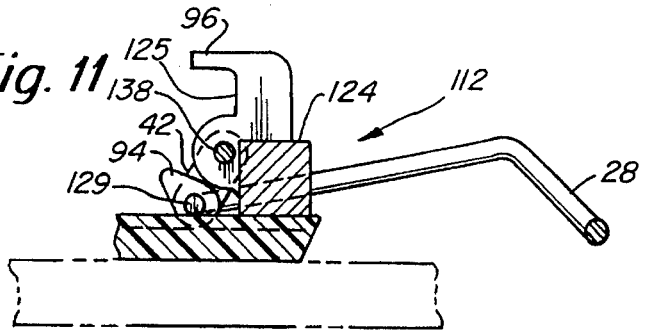
FIG. 11 is a section taken along contour line 11—11 of FIG. 8.
Figure 12:
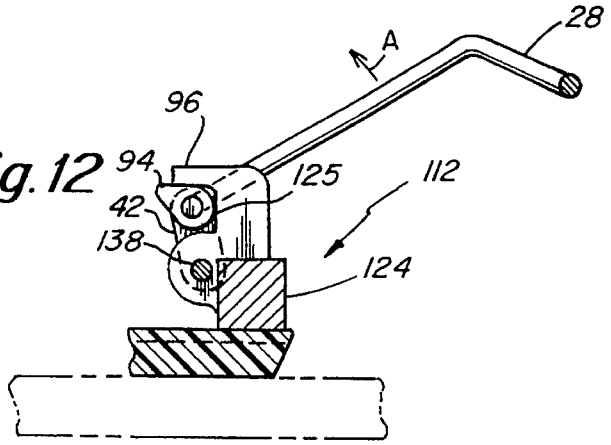
FIG. 12 is similar to FIG. 11, however, showing the bail in position to mate with the operating lever.
Figure 13:
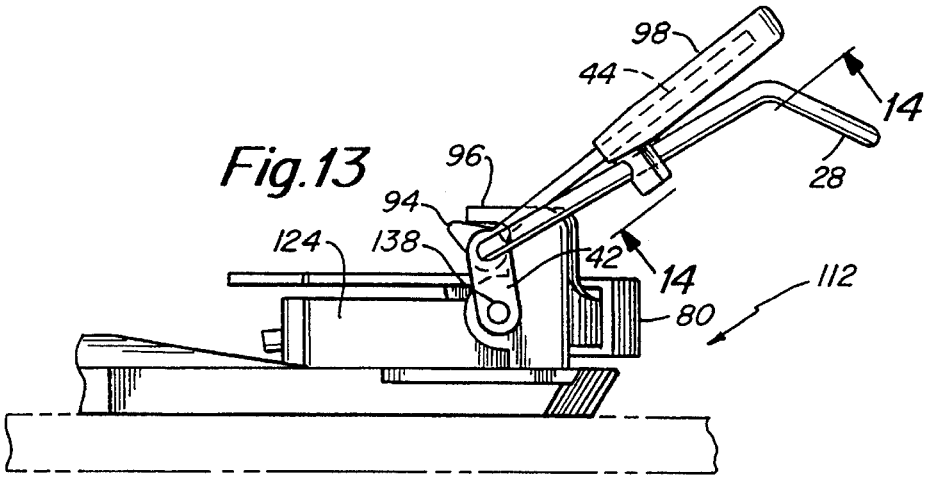
FIG. 13 is a fragmentary side elevation showing the bail and opening lever in the mated position.

To facilitate the lifting of the operating arm 44 an operating arm cover 98 may be used (See FIG. 13 and 15). The operating cover 98 is preferably made of plastic and includes a male projecting member 100, as illustrated in FIGS. 9 and 15. As the operating arm 44 is rotated in a clockwise direction to the opened position, the ends 129 of the bail are also lifted in the clockwise direction. When the cams 94 contact the forwardly extending projection 96, continued rotation of the operating arm 44 causes bail 28 to rotate in the counterclockwise direction, as indicated by arrow A in FIG. 12. Thus, the operating arm is rotated in a clockwise direction and the bail 28 simultaneously rotates in a counterclockwise direction. As the operating arm approaches the first position, bail 28 engages the protruding member 100, as illustrated in FIGS. 13–15. The protruding member 100 includes a recessed portion or detent 102 which receives bail 28 in a snap-like manner.

The user many now step into the binding by inserting the forward leg 66 of the boot under the forward or bail 26. The user no longer needs to rotate the rear bail 28 into contact with the rear surface of the boot 16. The user simply continues to step down on the cover plate 80. The weight of the heel of the user against the cover plate 80 causes the cam 146 and the shaft 138 to rotate in a counterclockwise direction against the spring loading of the plunger 50. When the cam reaches a position in which the axis of rotation of the plunger 50 is below the axis of the rotation of the shaft 138, the spring loading on the plunger will cause the cam and the shaft to rotate quickly further downward, in a counterclockwise direction. As a result, the axis of the rotation of the rear bail 28 is drawn forwardly and downwardly into the stable locked position, as illustrated in FIG. 9. Upon the downward movement of the cam 146 the protruding member 100 disengages from the rear bail 28 when the bail comes into contact with the rear surface of the boot. However, the rear bail 28 is prevented from bouncing off the boot and pivoting in the clockwise direction by the rear ledge 68 of the boot. The boot is now securely retained in the locked position, and can only be released by means of the operating arm 44 as discussed above.

It will be appreciated that the step-in boot binding of the present invention successfully prevents the binding from being inadvertently released from the locked position even in the event of failure of the trigger mechanism. From the foregoing description, it will be appreciated that the present invention makes available a compact, cost efficient, step-in type boot binding arrangement. The boot binding is designed to allow for simple operation while preventing an inadvertent unlocking of the boot binding.

Having described the presently preferred exemplary embodiments of a new and improved step-in boot binding arrangement in accordance with the present invention, it is believed that other modifications, variations and changes will be suggested to those skilled in the art in view of the teaching set forth herein. It is therefore, to be understood that all such variations, modifications, and changes are believed to fall within the scope of the present invention as defined by the appended claims.

What is claimed is:

1. A boot binding comprising:

(a) a base having front and rear ends;

(b) a first bail pivotally connected to said base at one of said ends;

(c) a second bail pivotally connected to said base at the other of said ends;

(d) an operating arm connected to said second bail and pivotally connected to said base;

(e) a trigger mechanism connected to said second bail to move said second bail from a first unlocked position to a second locked position, said trigger mechanism including a shaft that is rotatably connected to said base, said operating arm being pivoted in a first direction to cause said second bail to move from said second locked position to said first unlocked position; and (f) an eccentric link fixedly mounted on each axial end of said shaft for rotation therewith.

2. The boot binding as in claim 1, wherein said second bail is rotatably connected to said eccentric links at a distance from said shaft.

3. The boot binding as in claim 2, wherein said operating arm is fixedly connected to at least one of said eccentric links.

4. The boot binding as in claim 3, wherein said shaft is disposed in a plane below a top boot supporting surface of said base.

5. The boot binding as in claim 3, further including a cam mounted on said shaft and disposed between said eccentric links.

6. The boot binding as in claim 5, further comprising a plunger being pivotally connected to said cam at a first axial end of said plunger.

7. The boot binding as in claim 6, wherein said plunger is pivotally mounted about an axis is parallel to an axis of said shaft, said plunger pivot axis is spaced between the axis of said shaft and said first bail.

8. The boot binding as in claim 7, wherein said plunger is slidingly received in said base below the axis of said shaft.

9. The boot binding as in claim 8, wherein said plunger is spring biased toward said shaft.

10. The boot binding as in claim 1, further comprising a cam mounted on said shaft and disposed between said eccentric links.

11. The boot binding as in claim 10, further comprising a plunger being pivotally connected to said cam at a first axial end of said plunger.

12. The boot binding as in claim 10, further comprising:

a cam interlock being disposed adjacent to said cam, and a cover plate being coupled to said base, said cam interlock being slidably mounted on said base and is biased toward a first position to prevent rotation of said cam.

13. The boot binding as in claim 12, wherein said cover plate engages with said cam interlock to slide said cam interlock to a second position which permits rotation of said cam.

14. The boot binding as in claim 13, wherein said cover plate includes a downwardly depending projection which engages a portion of said cam to cause said trigger mechanism to move from said first unlocked position to said second locked position.

15. The boot binding as in claim 1, further comprising a cam being rigidly fixed to each end of said second bail.

16. The boot binding as in claim 15, further including a forwardly extending projection on said rear end of said base.

17. The boot binding as in claim 16, wherein said operating arm includes an operating arm cover having a male projecting member extending therefrom.

* * * * *